US006539992B1

(12) United States Patent
Nuss

(10) Patent No.: US 6,539,992 B1
(45) Date of Patent: Apr. 1, 2003

(54) RADIAL OVERARM ROUTER

(76) Inventor: Bart Andrew Nuss, 2408 Running Brook Trail, Fisherville, KY (US) 40023

( * ) Notice: Subject to any disclaimer, the term of this patent is extended or adjusted under 35 U.S.C. 154(b) by 0 days.

(21) Appl. No.: 09/972,498

(22) Filed: Oct. 5, 2001

(51) Int. Cl.[7] ..... B27C 5/00; B27C 9/00

(52) U.S. Cl. ..... 144/135.3; 144/48.6; 144/92; 144/135.2; 144/137; 144/365; 144/371; 408/236; 408/237; 83/471.3; 83/473

(58) Field of Search ..... 144/1.1, 2.1, 35.2, 144/48.6, 134.1, 135.2, 135.3, 136.1, 137, 92, 103, 365, 371, 154.1, 136.95; 83/471.2, 471.3, 473, 486.1, 701; 408/90, 135, 236, 237, 712

(56) References Cited

U.S. PATENT DOCUMENTS 1,674,669 A * 6/1928 Stedman ..... 408/237
2,341,061 A * 2/1944 Rhodes et al. ..... 144/135.3
2,587,520 A * 2/1952 Peplow ..... 408/237
2,856,799 A * 10/1958 De Curtis ..... 408/236
3,923,086 A * 12/1975 Spohn, Jr. ..... 144/135.3
4,187,601 A * 2/1980 Aldrin ..... 29/560
4,454,898 A * 6/1984 Pavnica ..... 144/35.2
4,463,785 A * 8/1984 Goeken ..... 144/35.2
5,193,595 A * 3/1993 Johnson ..... 144/135.3
5,299,609 A * 4/1994 Wedler ..... 144/154.5

* cited by examiner

*Primary Examiner*—W. Donald Bray
(74) *Attorney, Agent, or Firm*—Theresa Fritz Camoriano; Camoriano + Associates

(57) ABSTRACT

A radial overarm router is disclosed. The radial overarm router includes a machine base with a work surface, a vertical column, a bearing housing, a slide assembly, and a carriage subassembly. The bearing housing is mounted to, and may rotate about, the vertical column. The slide assembly mounts to the bearing housing and in combination with the bearing housing, the slide assembly has translational and rotational motion relative to the column. The slide assembly includes a carriage subassembly that houses a router. The carriage subassembly is configured to allow pivotal and vertical or plunge type motion of the router. The carriage subassembly further provides for transverse movement of the router. Locking knobs and adjustable limit stops are provided for all directions of movement. All of these motions may be fixed by the locking knobs to use the router in a stationary position; or any combination of the motions may be employed to perform a variety of routing and shaping operations including rabbets, dados, stopped grooving and slots, pockets, mortises, tenons, and curved moldings.

19 Claims, 3 Drawing Sheets

RADIAL OVERARM ROUTER

CROSS-REFERENCE TO RELATED APPLICATIONS

Not Applicable.

BACKGROUND

1. Field of Invention

This invention relates in general to routers and, more particularly, to an apparatus for adjustably positioning and moving a router and bit relative to a workpiece.

2. Description of Prior Art

The router is among the most versatile of woodworking tools. When properly guided or fixtured it can be used to cut rabbets, dados, mortises, tenons and perform a variety of other wood shaping operations. A number of guides and fixtures are available commercially or can be shop or custom made to accomplish these tasks. Each operates generally independently of the others and can require considerable time to set up and adjust. Additionally, these fixtures provide a limited range of motion and limited amount of adjustment of the position of the cutting tool. Inventors have created devices in an effort to overcome these shortcomings. U.S. Pat. No. 3,923,086 to Spohn (1975) discloses an adjustable radial arm apparatus for use with a router. Likewise U.S. Pat. No. 5,287,900 to Falco (1994) discloses a radial arm router table. Both of these inventions suffer from the disadvantage of having a rigid and fixed radial arm extending over the work surface, thus diminishing the operators field of view. Further, the fixed radial arm hinders access to the router for changing or servicing the bit or making adjustments.

SUMMARY OF THE INVENTION

It is the object of this invention to provide an improved mechanism to accurately and repeatably position or move a router and corresponding bit to perform a variety of wood shaping operations. It is a further object of this invention to provide a radial arm mechanism that provides an unobstructed view of the workpiece and unobstructed access to the router and bit.

DRAWING FIGURES

In the drawings, closely related figures have the same number but different alphabetic suffixes.

DESCRIPTION OF THE PREFERRED EMBODIMENT

Figure 1:
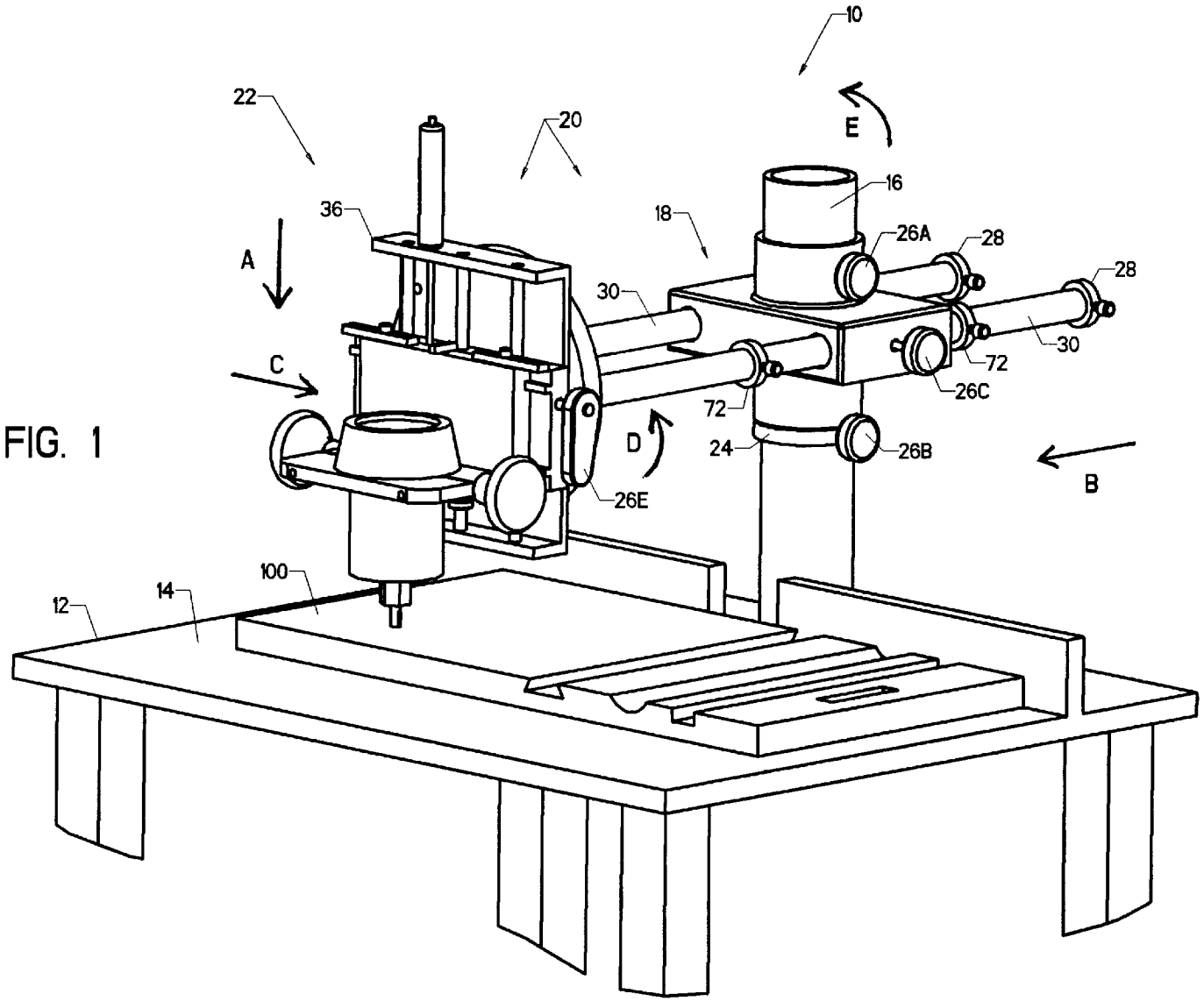
FIG. 1 is a front perspective view of the radial overarm router constructed in accordance with the present invention, the machine base of which is shown in fragment.
Figure 2:
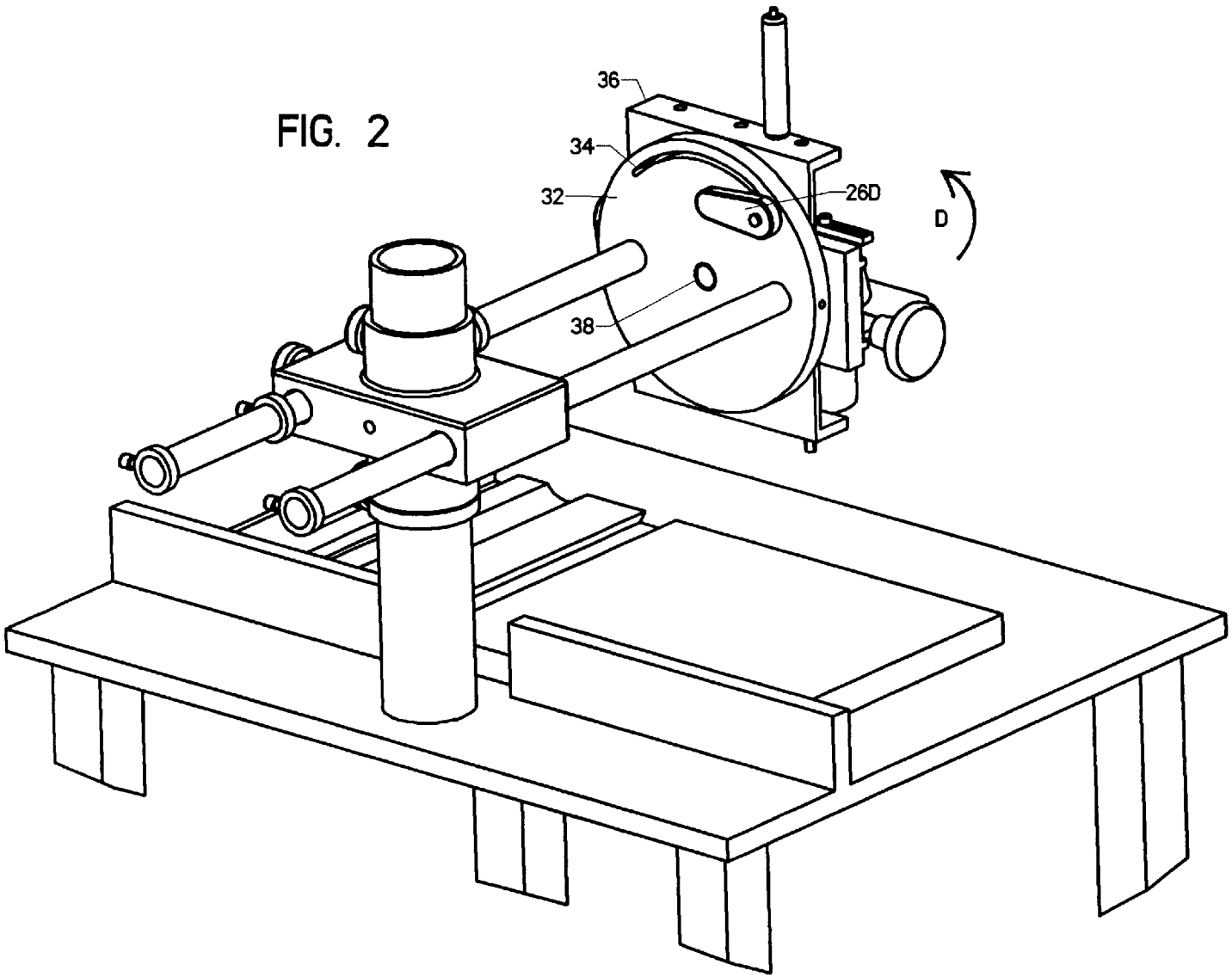
FIG. 2 is a rear perspective view of the slide assembly of the present invention.
Figure 3:
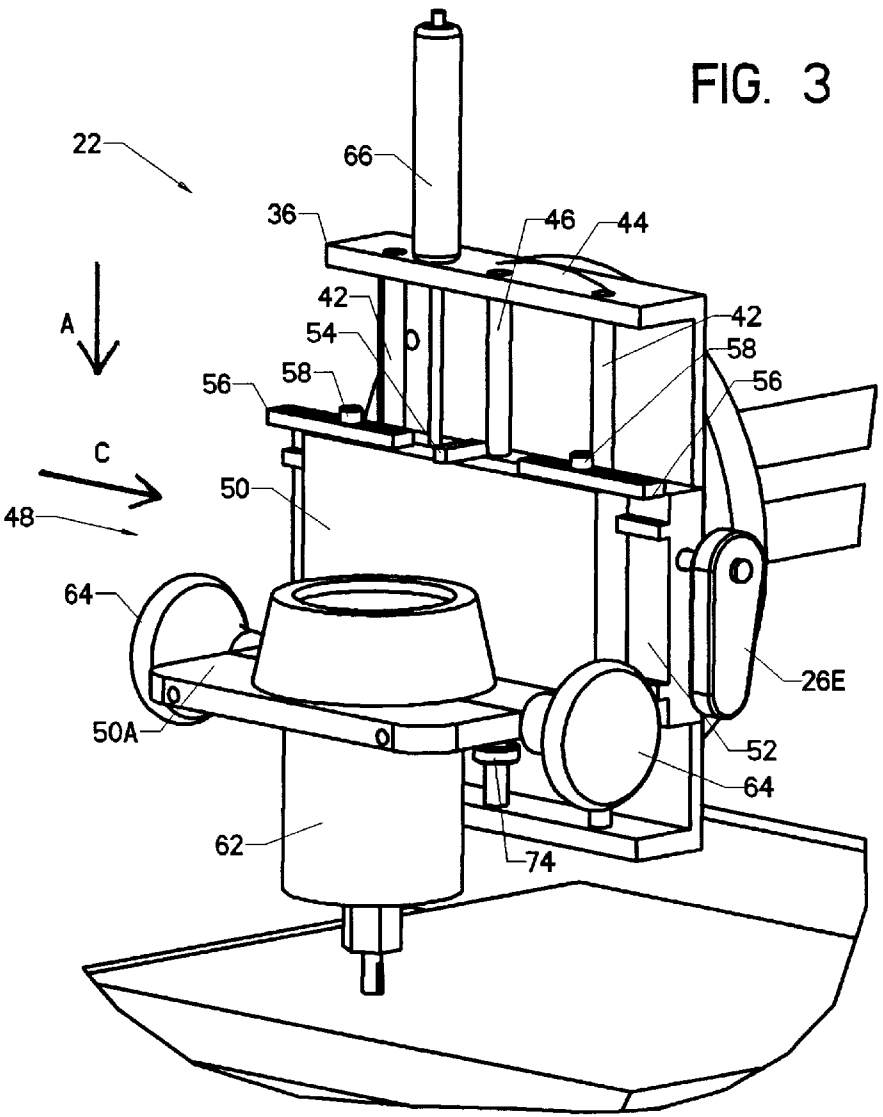
FIG. 3 is a detailed front perspective view of the carriage assembly

With reference to the drawings, the apparatus is generally indicated by reference numeral 10. Apparatus 10 comprises a machine base 12, a work surface 14, a vertically disposed cylindrical column 16, a bearing housing 18, a slide assembly 20, and a carriage subassembly 22. Bearing housing 18 is disposed slidably and pivotably to the vertical column 16. A locking knob 26A may be engaged to prevent rotation of bearing housing 18 about column 16. The axial position of bearing housing 18 on column 16 is maintained by abutment to a column stop 24. Column stop 24 is slidably and adjustably disposed on column 16 and selectively secured by a locking knob 26B.

Bearing housing 18 serves as a collar mounted on the cylindrical column 16, permitting linear movement along the axis of the column and rotational movement about the axis of the column 16. Extending through bearing housing 1 8 are one or more forward-to-aft-directed linear guide members or rods 30. The bearing housing 18 includes means to allow for manually linearly sliding the rods 30 relative to the housing or collar 18 and perpendicular to column 16. These means may be provided by standard bearings or sleeves well known in industry. Adjustable stop collars 72 may be engaged forward and aft of the housing or collar 18 to selectively limit linear motion of rods 30. Further, a locking knob 26C may be engaged to prevent linear motion of rods 30 and subsequently slide assembly 20. Carriage subassembly 22 is disposed at forward end of rods 30. Stop collars 28 are fixed to aft end of rods. A mounting plate 32 is disposed perpendicular to ends of rods 30. Mounting plate 32 includes an arc shaped slot 34. A locking knob 26D passes through slot 34 and secures to a plate having a "C"-shaped cross-section, including first and second parallel, horizontal legs and a web interconnecting the legs, frequently referred to herein as a "C" plate 36. "C" plate 36 is pivotably disposed to mounting plate 32 by means of a pin 38. Locking knob 26D may be engaged to prevent rotation of "C" plate 36 and subsequently carriage subassembly 22 about pin 38.

Further, "C" plate 36 includes linear guide members or rods 42 perpendicularly disposed to surface 44 and parallel and substantially apart from each other. The guide members or rods 42 extend between the horizontal legs of the "C" plate and have longitudinal axes lying in a plane substantially perpendicular to the axes of the forward-to-aft rods 30. The "C" plate 36 further includes a threaded rod 46 disposed parallel to rods 42. The carriage subassembly 22 further includes a front bearing housing 48 slidably disposed on rods 42. Threaded rod 46 passes through front bearing housing 48. Locking knob 26E may be engaged to prevent linear motion of front bearing housing 48 relative to "C" plate 36. Front bearing housing 48 is comprised of a front plate 50 and an aft plate 52 wherein front plate 50 is slidably disposed to aft plate 52. Front bearing housing 48 further includes stops 56 with securing means, for example screws 58, and a tab 54 disposed above and flush with top surface of aft plate 52 and between stops 56. Stops 56 are slidably and adjustably disposed to front plate 50 by screws 58. Front plate 50 further includes a horizontal member 50A and knobs or handles 64 mounted on opposing sides of horizontal member 50A of front plate 50. Front plate 50 further includes a means to accept and secure a router 62, for example a hole with a tensioning screw.

A spring device 66 is disposed to "C" plate 36 and is biased to urge front bearing housing 48 to the top of the "C" plate. A stop nut 74 is threaded onto threaded rod 46 below front bearing housing 48.

Operation

Referring now again to the figures, the apparatus 10 operates as follows: A workpiece 100 is placed on and secured to work surface 14. Means of securing the workpiece is not part of this invention and is therefore not detailed. The operator grasps and controls the apparatus by handles 64. By releasing locking knob 26E and providing a downward force in the direction of arrow A, plunge type cuts can be made in the workpiece. Depth of plunge cuts are controlled by adjusting stop nut 74 on threaded rod 46. Locking knob 26E may be re-engaged at any time to maintain the plunge cut at the desired depth. Additionally, by releasing knob 26C and providing force in the direction of arrow B, grooves, slots, dados or rabbets may be cut into the workpiece. The amount of travel in the direction of arrow B may be controlled by adjusting and securing stops 72 on rods 30. Stopped dados and similar cuts may be made by this means. The width of the grooves or slots in the direction of arrow C is controlled by adjusting stops 56 which allows for transverse motion of the router 62 relative to front bearing housing 48. It is easily seen that combination of the above operations allows for easily creating mortises to receive tenons. Following plunge type cuts, spring device 66 serves to return front bearing housing 48 and subsequently router 62 to the starting or raised position. Carriage subassembly 22 may be rotated up to 90 degrees in direction of arrow D by releasing locking knob 26*d* and applying rotational force in the direction of arrow D. Carriage subassembly 22 may be secured with locking knob 26D at any included angle in order to perform the above said operations at an angle to the workpiece other than 90 degrees. It can easily be seen that locking the carriage subassembly 22 in the horizontal position provides for easy access for bit changes. Locking knob 26A may be disengaged in order to rotate slide assembly 20 in direction of arrow E about column 16. This allows for positioning the router to make the above cuts at additional angles to the workpiece. This configuration may also be use to make circular or arc cuts in the workpiece by rotating the slide assembly in the direction of arrow E during a cutting operation.

I claim:

1. A radial overarm router, comprising:

a machine base with horizontal work table;

a vertically disposed column projecting upwardly above said work table and defining an axis;

a collar slidably mounted on said vertically disposed column for sliding axially along said column and for rotatably sliding about the axis of said column;

a slide assembly mounted on said collar, including at least one linear guide rod having a forward end and an aft end;

a mounting plate disposed at the forward end of said linear guide rod;

a fixed limit stop disposed at the aft end of said linear guide rod;

a carriage subassembly for affixing a router to said slide assembly; and means for selectively locking said collar in a fixed position on said column.

2. A carriage subassembly comprising:

a plate having a substantially "C"-shaped cross-section, including first and second parallel legs and a web extending between and connecting together said legs;

a plurality of linear guide rods disposed parallel and substantially apart and extending between said first and second parallel legs;

a forward bearing housing slidably disposed about said linear guide rods;

a spring mechanism to bias the forward bearing housing toward the first of said parallel legs;

a horizontal mounting plate having left and right opposed sides, said horizontal mounting plate being mounted to said forward bearing housing for disposing a router in a generally vertical position; and operator handles disposed on said left and right opposed sides of said horizontal mounting plate.

3. A carriage subassembly of claim 2 wherein the said forward bearing housing comprises:

an aft portion and a forward portion wherein the forward portion may slidably and generally horizontally move relative to the aft portion;

limit stops which may be selectively and reversibly positioned to limit travel of the forward portion of the forward bearing assembly;

a locking means to selectively and reversibly affix slidable movement of the forward bearing housing on the "C" plate linear guide rods;

handles mounted on opposing sides.

4. A carriage subassembly of claim 2 further including a selectively and reversibly limit stop means comprising:

a threaded rod mounted in the "C" plate parallel to the linear guide rods and passing through a clearance bore in the aft forward bearing housing plate an adjustable nut on said threaded rod and below said aft front bearing housing plate.

5. A radial overarm router, comprising:

a base;

a substantially vertical column projecting upwardly above said base;

a collar mounted on said column;

at least one forward-to-aft-directed guide rod defining a longitudinal axis and mounted on said collar for axial movement relative to said collar;

a first stop mounted on the aft portion of said forward-to-aft-directed guide rod;

a carriage mounted on said forward-to-aft-directed guide rod, including at least one forward guide rod defining a longitudinal axis lying in a plane substantially perpendicular to the axis of said forward-to-aft-directed guide rod;

a router mounted for axial movement along said forward guide rod; and a first adjustable stop controlling the amount of axial movement of said router along said forward guide rod.

6. A radial overarm router as recited in claim 5, and further comprising a second adjustable stop, mounted on said forward-to-aft-directed guide rod forward of said collar.

7. A radial overarm router as recited in claim 6, and further comprising a column stop mounted on said column below said collar, wherein said collar is rotatable about said column.

8. A radial overarm router as recited in claim 7, and further comprising left and right handles mounted on said router mount.

9. A radial overarm router as recited in claim 8, and further comprising means for selectively locking said collar relative to said column.

10. A radial overarm router as recited in claim 5, wherein said carriage defines a forward-to-aft pivot axis and said router is mounted on said carriage for rotation about said pivot axis.

11. A radial overarm router as recited in claim 10, and further comprising means for selectively locking said carriage against rotation about said pivot axis at any position within an angular range.

12. A radial overarm router, comprising:

a base;

a substantially vertical column projecting upwardly above said base;

a collar mounted on said column;

a first forward-to-aft guide rod mounted on said collar and axially movable relative to said collar in the forward-to-aft direction;

a carriage mounted on the aft portion of said forward-to-aft guide rod, including a mount for mounting a router;

a first guide means a direction substantially perpendicular to said forward-to-aft direction; and a forward-to-aft-directed pivot shaft which permits said mount to pivot relative to the forward-to-aft guide rod within a range of angular positions.

13. A radial overarm router as recited in claim 12, wherein said column has an outer surface with a cylindrical cross-section, and said collar is rotatable about said column.

14. A radial overarm router as recited in claim 12, and further comprising at least one adjustable stop mounted on said forward-to-aft guide rod.

15. A radial overarm router as recited in claim 14, and further comprising a second adjustable stop including means for limiting the motion of said first guide means.

16. A radial overarm router as recited in claim 15, and further comprising a selective locking means for locking said mount at any desired angular position within said range.

17. A radial overarm router as recited in claim 15, and further comprising a second forward-to-aft guide rod mounted parallel to said first forward-to-aft guide rod and axially slidable relative to said collar.

18. A radial overarm router as recited in claim 17, and further comprising a router mounted on said mount.

19. A radial overarm router as recited in claim 18, and further comprising means for selectively locking said collar relative to said column.

* * * * *

UNITED STATES PATENT AND TRADEMARK OFFICE

CERTIFICATE OF CORRECTION

PATENT NO. : 6,539,992 B1 
DATED : April 1, 2003
INVENTOR(S) : Bart Andrew Nuss

It is certified that error appears in the above-identified patent and that said Letters Patent is hereby corrected as shown below:

Column 5,
Line 7, after "a first guide means" insert -- for guiding said mount in --.

Column 6,
Line 7, delete "15" and insert therefor -- 12 --.

Signed and Sealed this

Twenty-second Day of July, 2003

JAMES E. ROGAN
*Director of the United States Patent and Trademark Office*